US009120215B2

(12) United States Patent
Muenchrath et al.

(10) Patent No.: US 9,120,215 B2
(45) Date of Patent: Sep. 1, 2015

(54) SUSPENSION BUSHING SERVICE TOOL AND METHOD OF USE

(71) Applicants: Darren Muenchrath, Rockyford (CA); Ryan Stormoen, Rockyford (CA)

(72) Inventors: Darren Muenchrath, Rockyford (CA); Ryan Stormoen, Rockyford (CA)

( * ) Notice: Subject to any disclaimer, the term of this patent is extended or adjusted under 35 U.S.C. 154(b) by 276 days.

(21) Appl. No.: 13/624,709

(22) Filed: Sep. 21, 2012

(65) Prior Publication Data

US 2013/0074306 A1 Mar. 28, 2013

Related U.S. Application Data

(60) Provisional application No. 61/538,695, filed on Sep. 23, 2011.

(51) Int. Cl.
*B25B 27/06* (2006.01)
*B25B 27/28* (2006.01)

(52) U.S. Cl.
CPC ..... *B25B 27/064* (2013.01); *B25B 27/28* (2013.01); *Y10T 29/49822* (2015.01); *Y10T 29/49945* (2015.01); *Y10T 29/5383* (2015.01); *Y10T 29/53987* (2015.01)

(58) Field of Classification Search
CPC ..... B25B 27/06; B25B 27/064; B25B 27/02; B25B 27/026; B25B 27/28
USPC ..... 29/234, 235, 244, 252, 254, 255, 282, 29/898.07, 898.08, 426.5, 525
See application file for complete search history.

(56) References Cited

U.S. PATENT DOCUMENTS

| | | | | | |
|---|---|---|---|---|---|
| 1,501,815 | A * | 7/1924 | Seppmann | 29/275 |
| 1,807,329 | A * | 5/1931 | West et al. | 29/252 |
| 1,863,956 | A * | 6/1932 | Wilson | 29/275 |
| 2,013,923 | A | 9/1935 | Naccarato | |
| 2,457,930 | A * | 1/1949 | Smith | 29/235 |
| 2,691,402 | A * | 10/1954 | Swanson et al. | 156/423 |
| 2,807,081 | A * | 9/1957 | Black | 29/252 |
| 3,237,294 | A * | 3/1966 | Brandeberry | 29/898.01 |
| 3,391,803 | A * | 7/1968 | Povlacs | 414/744.2 |
| 4,464,818 | A * | 8/1984 | Kubota | 29/252 |
| 4,724,608 | A | 2/1988 | Parrott | |
| 4,852,231 | A * | 8/1989 | Turner | 29/888.05 |
| 5,317,793 | A * | 6/1994 | Boyd et al. | 29/252 |
| 5,363,543 | A * | 11/1994 | Boyd et al. | 29/464 |
| 5,404,631 | A * | 4/1995 | Boyd et al. | 29/426.5 |
| 5,713,117 | A * | 2/1998 | Bliss | 29/257 |
| 6,484,391 | B1 * | 11/2002 | Dillon et al. | 29/790 |
| 6,505,390 | B2 * | 1/2003 | Emanuel | 29/426.5 |
| 6,745,447 | B2 | 6/2004 | Smith | |
| 7,562,518 | B2 * | 7/2009 | Daniels et al. | 59/7 |
| 2006/0085964 | A1 * | 4/2006 | Brown | 29/434 |

FOREIGN PATENT DOCUMENTS

| | | | | |
|---|---|---|---|---|
| DE | 19831989 A1 * | 1/2000 | | B25B 27/02 |
| EP | 506157 A1 * | 9/1992 | | B25B 27/06 |

* cited by examiner

*Primary Examiner* — Essama Omgba
(74) *Attorney, Agent, or Firm* — Goodwin Law; Sean Goodwin

(57) ABSTRACT

A lightweight and portable service tool and method of use is provided for facilitating bushing replacement without removal of suspension from a vehicle. A tool end removably straddles the suspension and anchors the tool to the suspension. An actuator end, connected to the tool end, imparts a bushing jacking force along a common tool axis for extracting a bushing from, or installing a bushing into an eyelet of the suspension. The actuator end can form a jack or form a bore for receiving a portable jack as the source of the jacking force.

12 Claims, 16 Drawing Sheets

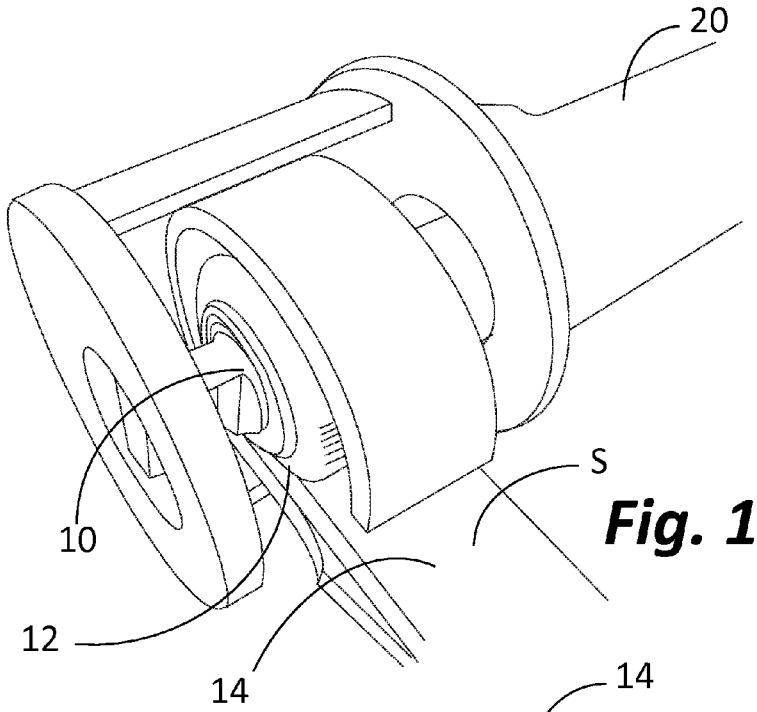
Fig. 1A
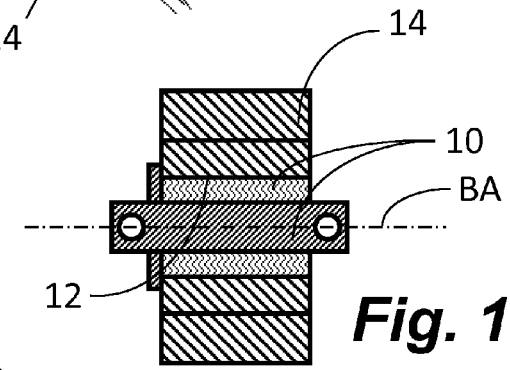
Fig. 1C
Fig. 1B
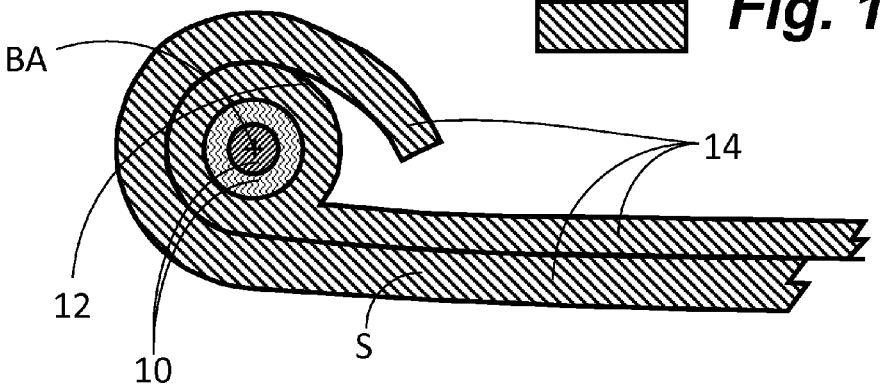

20
24
26
42
54
41

24
40
A
A
20
50

C
C
A
26
46b
27
52
20
46a
42
41
48
28
40
50
B
B

SUSPENSION BUSHING SERVICE TOOL AND METHOD OF USE

FIELD

A service tool and method of use is provided for the extraction and installation of bushings into vehicular suspension.

BACKGROUND

The suspension for heavy vehicles, including trucks and trailers, is typically supported with leaf springs and beam suspensions. Beam suspension and leaf springs are positioned between an axle, or axle assembly, and the load carrying frame. Beams and leaf springs are normally terminated at each of two ends with a circular eyelet. A bushing passes though the eyelet and connects at bushing pin ends to a hanger or other structure secured to the vehicle frame. The bushing includes an annular elastomeric element (rubber or polyurethane) about the pin to provide some vibration isolation and permit some limited rotation at the eyelet.

As an example, leaf springs are manufactured of spring steel and, over time, rust can form between the eyelet and the bushing, causing difficulty during eventual replacement. In highway trailer axle assemblies, which operate in severe conditions, bushings can require replacement at frequent intervals.

Applicant's experience has been that bushing replacement, such as that for suspensions including a variety of Henrickson suspension (Hendrickson Truck Systems Group, Woodridge, Ill., USA), can require removal of the suspension and use of a hydraulic press, typically found in a service shop environment, to force the bushing from the eyelet.

For example, refurbishing of bushings for a tri-axle trailer entails: removal of the six leaf springs, press removal of the bushings, installation of a new bushings and reinstallation of the six leaf springs on the trailer. This operation can take as much as 6 to 8 hours and require access to a shop press.

SUMMARY

In embodiments described herein, a service tool is provided for facilitating bushing replacement without removal of suspension from a vehicle, including trucks and trailers. The tool is lightweight and usable by one person for reducing the time needed for bushing replacement to about one-half of that currently required. For example, re-bushing a tri-axle trailer can now take as little as 3 hours. The tool can be used in the field or in a shop environment.

In one aspect, a service tool for extracting and installing a bushing in an eyelet of a vehicular suspension comprises a frame having an actuator end and a tool end, the actuator end and tool end aligned along a longitudinal tool axis. The tool end forms a housing port, open laterally to a side of the frame, and is aligned along the tool axis between an anchor plate and the actuator end. The anchor plate is connected to the actuator end and has an extraction port therethrough along the tool axis. The housing port is sized to accept the suspension from the side of the frame with the housing adjacent the anchor plate. A bushing is aligned along the tool axis, and the actuator is operable between the actuator end and the bushing. When actuated, the actuator, supported at the actuator end, urges the suspension to bear against the anchor plate for support. For installation, the bushing is urged into the supported suspension. For extraction, the bushing is urged out of the supported suspension and at least partially through the through port.

The actuator can be a portable hydraulic jack, the actuator end having an open side for removably receiving the jack therein.

In another aspect, a method for insitu extraction and installation of bushings from and into an eyelet of a vehicular suspension using a service tool is provided comprising disconnecting the suspension bushing from the vehicular frame, the bushing supported in a suspension eyelet and orienting the service tool's tool end over the eyelet and bushing. Then one commences jacking against an actuator end of the service tool to drive against the bushing. The eyelet is supported at the tool end and, for installation, one drives the bushing into the eyelet suspension, and, for extraction, one drives the bushing out of the eyelet.

BRIEF DESCRIPTION OF THE DRAWINGS

FIG. 1A is a perspective view of an eyelet end and bushing of a two leaf, leaf spring arranged within a service tool according to one embodiment;

FIG. 1B is a partial side view of the eyelet end of the leaf spring according to FIG. 1A;

FIG. 1C is a cross-sectional view of the leaf spring of FIG. 1B, and bushing extending therethrough;

FIG. 5A arranging the tool about the suspension spring and positioning a new bushing and adapter in the service tool, FIG. 5B engaging the bushing with the eyelet, FIG. 5C inserting the portable hydraulic ram, FIG. 5D engaging the ram with the adapter, FIG. 5E pressing the bushing into the eyelet, FIG. 5F recovering the hydraulic ram and adapter, and FIG. 5G removing the service tool.

DESCRIPTION OF THE PREFERRED EMBODIMENTS

Replacement of a vehicular suspension bushing without the need to remove the suspension from the vehicle saves significant time and is convenient. A service tool is described herein in the context of a leaf spring suspension, however the tool is equally applicable to other eyelet and bushing arrangements such as that in beam-type and other forms of suspension S.

As shown in FIGS. 1A, 1B and 1C, a bushing 10 is shown fit to an eyelet 12 of a leaf spring 14 embodiment of suspension S. As shown in FIG. 1A, a service tool 20 is provided for extracting or installing the bushing 10 from or into an eyelet of the suspension S. The service tool 20 can be used in-situ, brought to the location of the vehicle requiring a bushing replacement, or alternatively, if the vehicle is already in a shop, or the suspension has been removed, the tool can be also be used in a shop location. Similarly, a replacement or new bushing 10 can be installed with the service tool 20, the service tool functional as an extraction tool, an installation tool, or both.

Figures 2A, 2B, 2C:
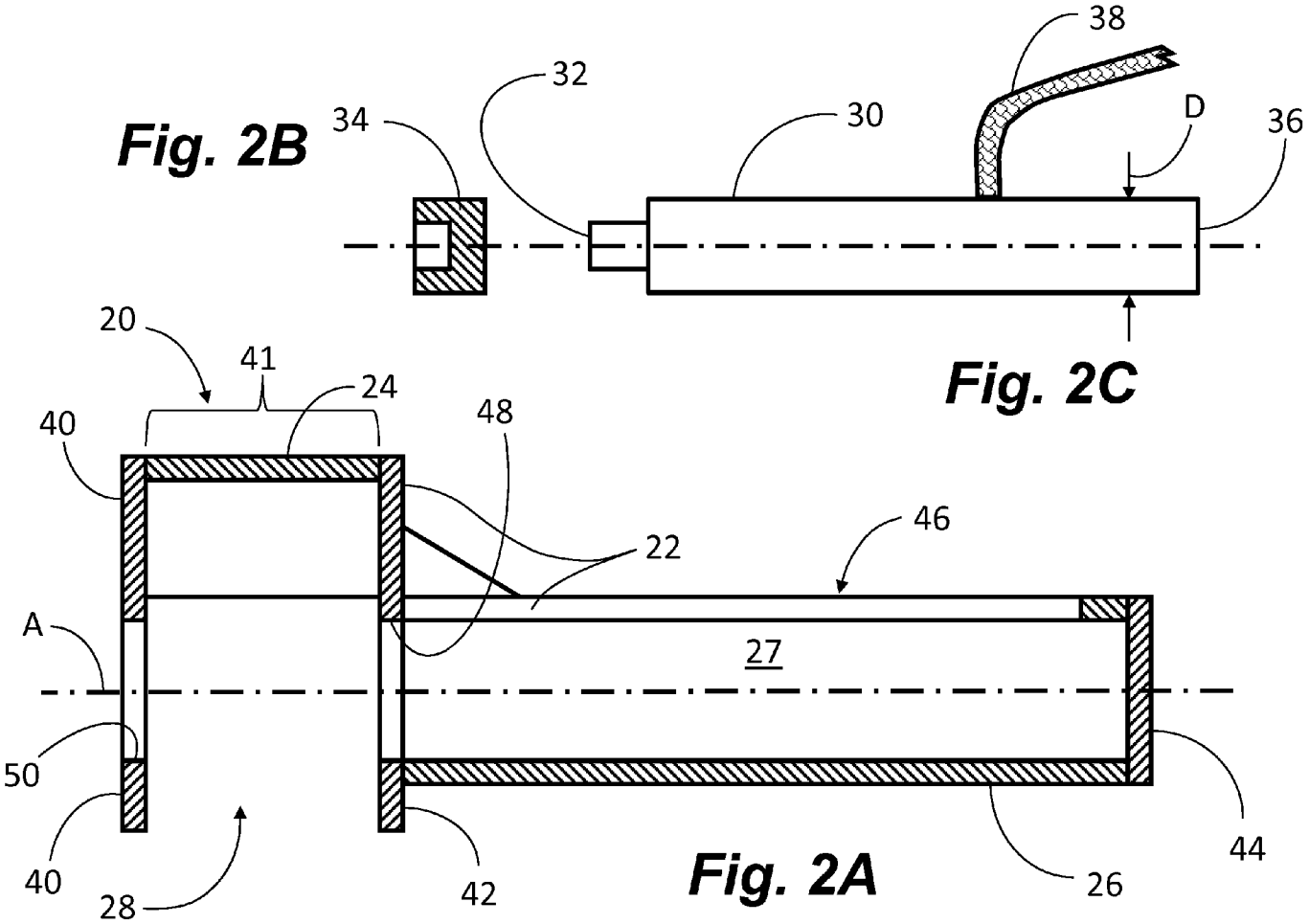
FIG. 2A is a side, cross sectional view of a housing for an embodiment of a bushing service tool.
FIG. 2B is a side view of a conventional portable power hydraulic ram, an actuating pump not shown.
FIG. 2C is a side cross-sectional view of a bushing extraction adapter complementary to the service tool and hydraulic ram of FIGS. 2A and 2B.
Figure 2D:
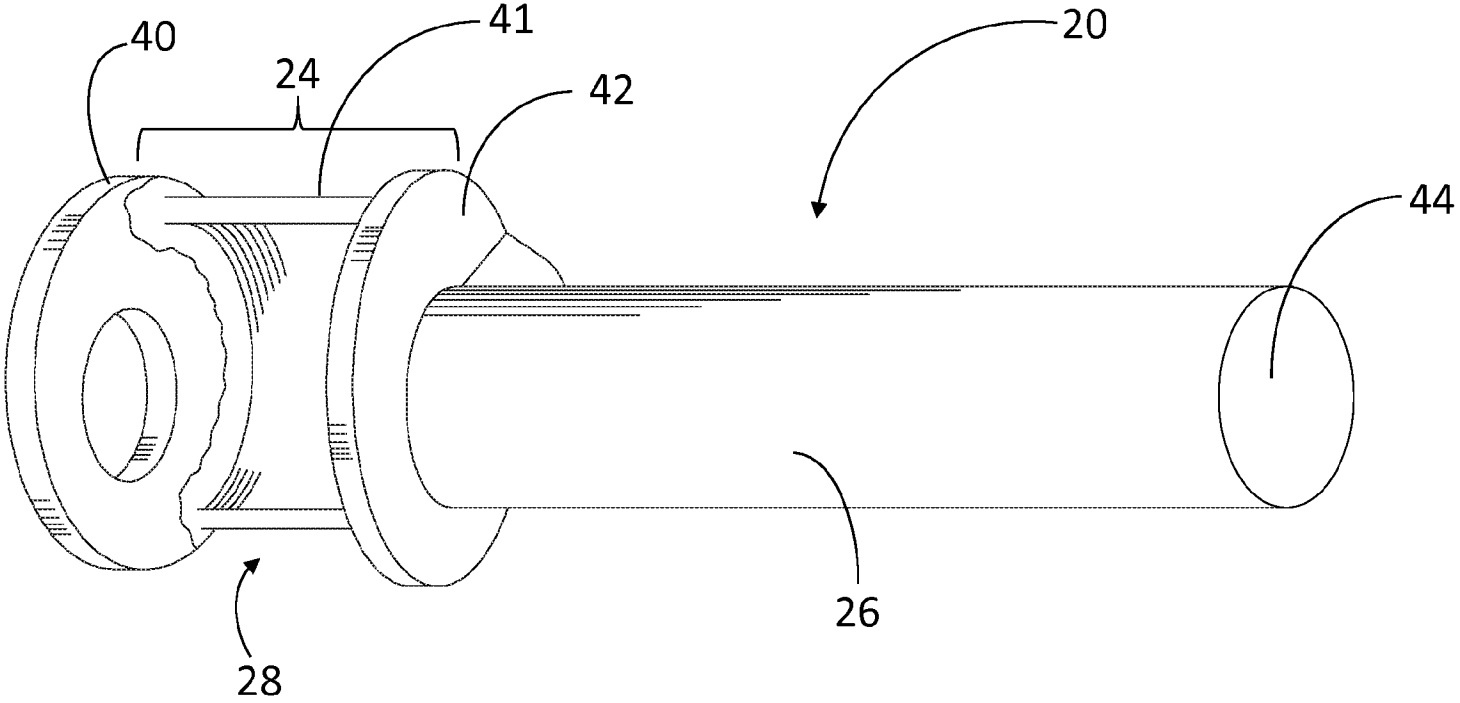
FIG. 2D is a perspective view of a service tool according to FIGS. 2A to 2C.

As shown in FIGS. 2A and 2D, the service tool 20 comprises a frame 22 having a first suspension or first tool end 24, and a second actuator end 26. The tool end 24 and actuator end 26 are aligned along a longitudinal tool axis A.

The first tool end 24 has an open, C-shape housing port 28 for straddling the suspension S and bushing 10. The bushing 10 has a bushing axis BA which is concentric with the eyelet 12. The bushing axis BA is alignable with the tool axis A.

The second actuator end 26 provides a support from which to exert a bushing-extraction force. The service tool 20 is used in combination with an actuator 30 such as a jack for imparting the bushing-extraction force. The jack may be incorporated into the actuator end 26 or be removably positioned therein. A suitable jack is a portable hydraulic ram or power pack. The tool end 24 has an anchor plate 40 spaced apart from an interface plate 42 forming first and second straddle plates for forming the housing port 28 therebetween. The anchor plate 40 and interface plate 42 are connected by a wall or spacer 41 extending between the plates 40,42. The spacer 41 is circumferentially discontinuous for forming the housing port 28, yet structurally connects the anchor plate 40 and interface plate 42 together to transfer sufficient jacking forces to extract or install a bushing 10 from or into the suspension S.

The housing port 28 is open laterally to a side of the frame 22, the housing port sized to accept the suspension from a side of the frame 22 with the suspension arranged generally adjacent the anchor plate 40 and the bushing 10 aligned along the tool axis A.

As shown in FIGS. 2B and 2C, the actuator 30 is compatible for cooperation with the actuator end 26, removably situate with a bore 27 between a base plate 44, secured at a distal end of the actuator end 26, and the bushing 10. Depending upon the configuration of an axially movable and drivable working end 32 of the actuator 30, an adapter 34 can be provided to aid in coupling the bushing 10 and the actuator 30, such as to aid in separating an elastomeric portion of the bushing and the suspension S.

The frame's actuator end 26 comprises a tubular structure fit with a base plate 44 connected to, and spaced from, the tool end 24 for receiving the actuator 30 in bore 27 therebetween. The actuator end 26 is formed with an open side 46 for access to the bore 27 and receiving the jack 30 therein. The interface plate 42, connected to the actuator end 26 opposing the base end 44, is formed with a passage 48 therethrough sized to freely pass the bushing 10 and access to the suspension S. The anchor plate 40 is similarly formed with an extraction port 50 sized to freely pass the bushing 10 during extraction.

One form of actuator 30 is a linear actuator such as a hydraulic ram having a ram base or supported end 36, and a ram working end 32 movable relative to the supported end 36

When imparting force to the bushing, the actuator 30 is supported at an actuator's supported end 36 against the frame's base plate 44 for enabling a driving movement of the working end 32 away from the baseplate 44. Initially, the working end 32 urges the bushing 10, eyelet 12 and suspension S to bear against the anchor plate 40, and once the suspension is braced, the bushing can be driven relative thereto. The actuator 30 has an actuator diameter D. The hydraulic ram form of actuator comprises a hydraulic cylinder having laterally extending hydraulic line 38. The open side 46 is available for receiving and accommodating the line 38.

Figures 3A, 3B, 3C:
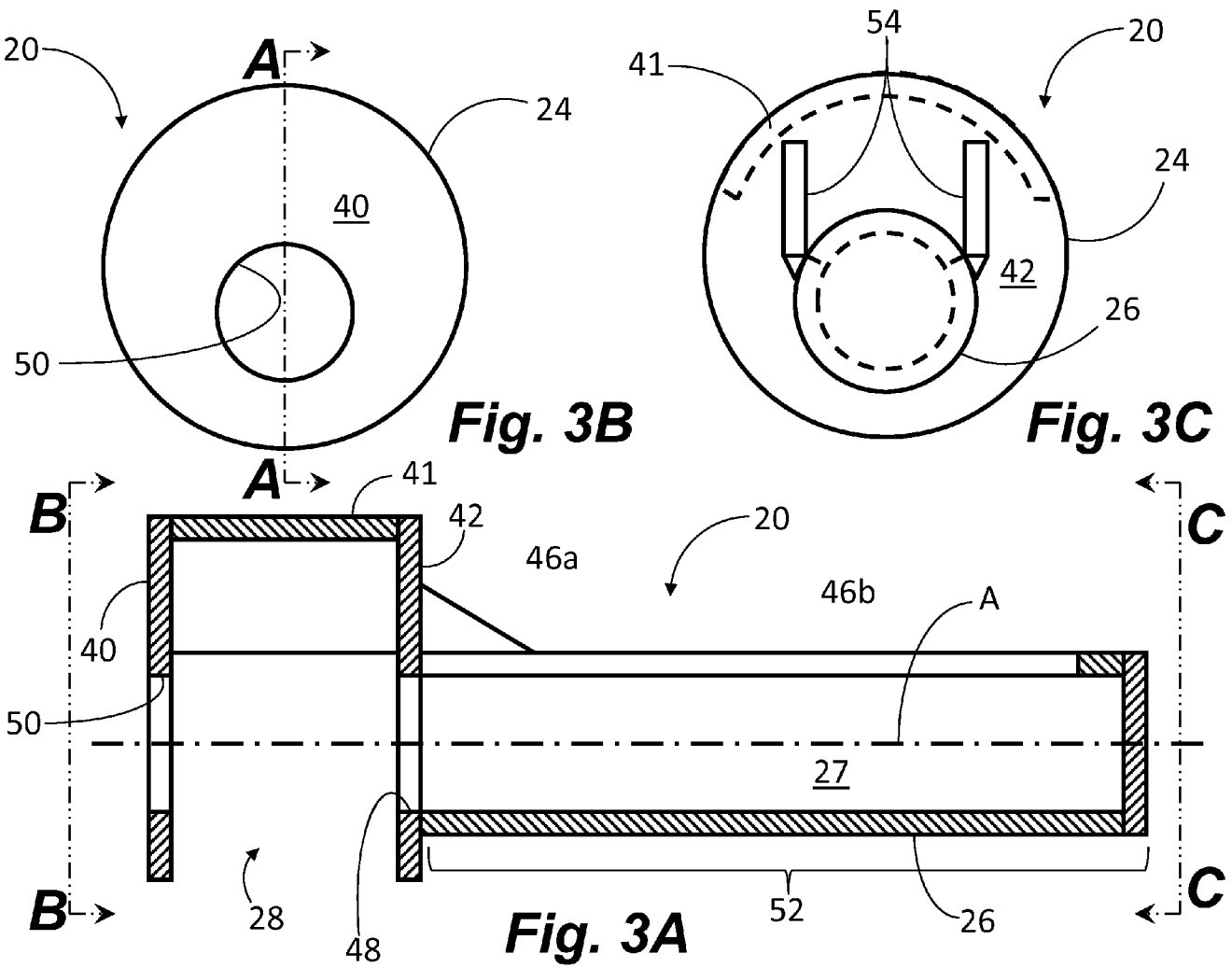
FIG. 3A is a side, cross sectional view of the housing for a bushing removal tool along A-A of FIG. 3B.
FIG. 3B is a first end view along B-B of FIG. 3A.
FIG. 3C is a second end view along C-C of FIG. 3A.
Figure 3D:
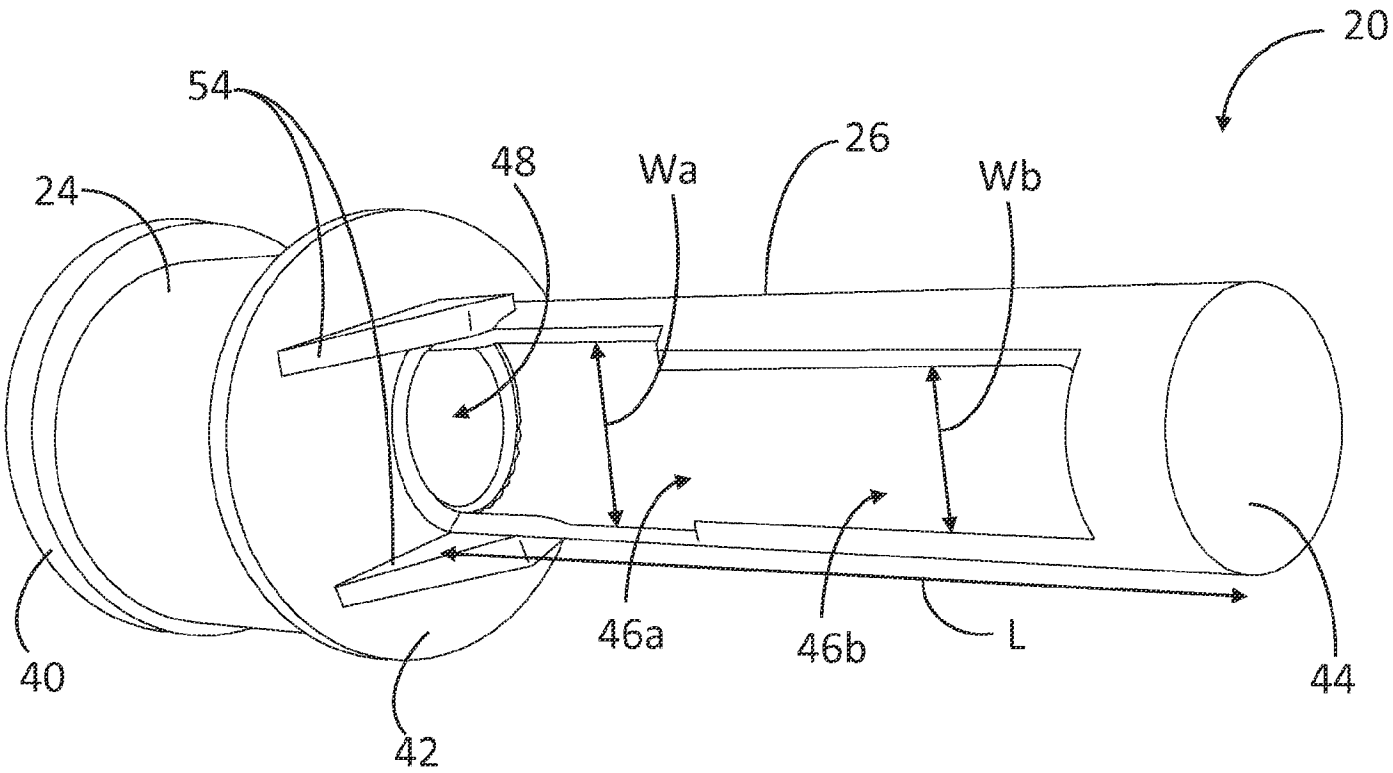
FIG. 3D is a perspective view of the service tool according to FIGS. 3A to 3C.

Best seen in FIG. 3D, the open side 46 can be one-sized (FIG. 2A) or stepped (FIGS. 3A and 3D) to permit entry and positioning of the bushing 10, adapter 34 and of the actuator 30 within the bore 27, each component of which can have similar or different lateral dimensions. As shown in FIG. 3D, the open side 46 has at least a first slot 46*a* having width Wa adjacent the tool end 24 for receiving the actuator 30 therein and having a longitudinal length L for receiving the actuator 30. A second slot 46*b* has a width Wb extending longitudinally from the first slot 46*a* to a location the adjacent the base plate 44, width Wb being smaller than width Wa. In an embodiment, width Wb can be smaller than that of the actuator 30 while accommodating the hydraulic line 38.

The actuator 30 provides the jacking force necessary to move the bushing 10 out of or into supported suspension S. The actuator can be a pushing device such as a portable power hydraulic unit (such as that represented in FIG. 2B). The actuator end 26 include a length of conduit or pipe that forms a connective spacer 52 between the interface and base plates 42,44. A portion of the connective spacer's side wall is removed, providing the open side 46 for accessing the bore 27 and tool axis A. The open side 46 enables insertion of new bushing 10, the bushing cup or adapter 34 (FIG. 2C) and the portable power hydraulic unit.

Figure 4A:
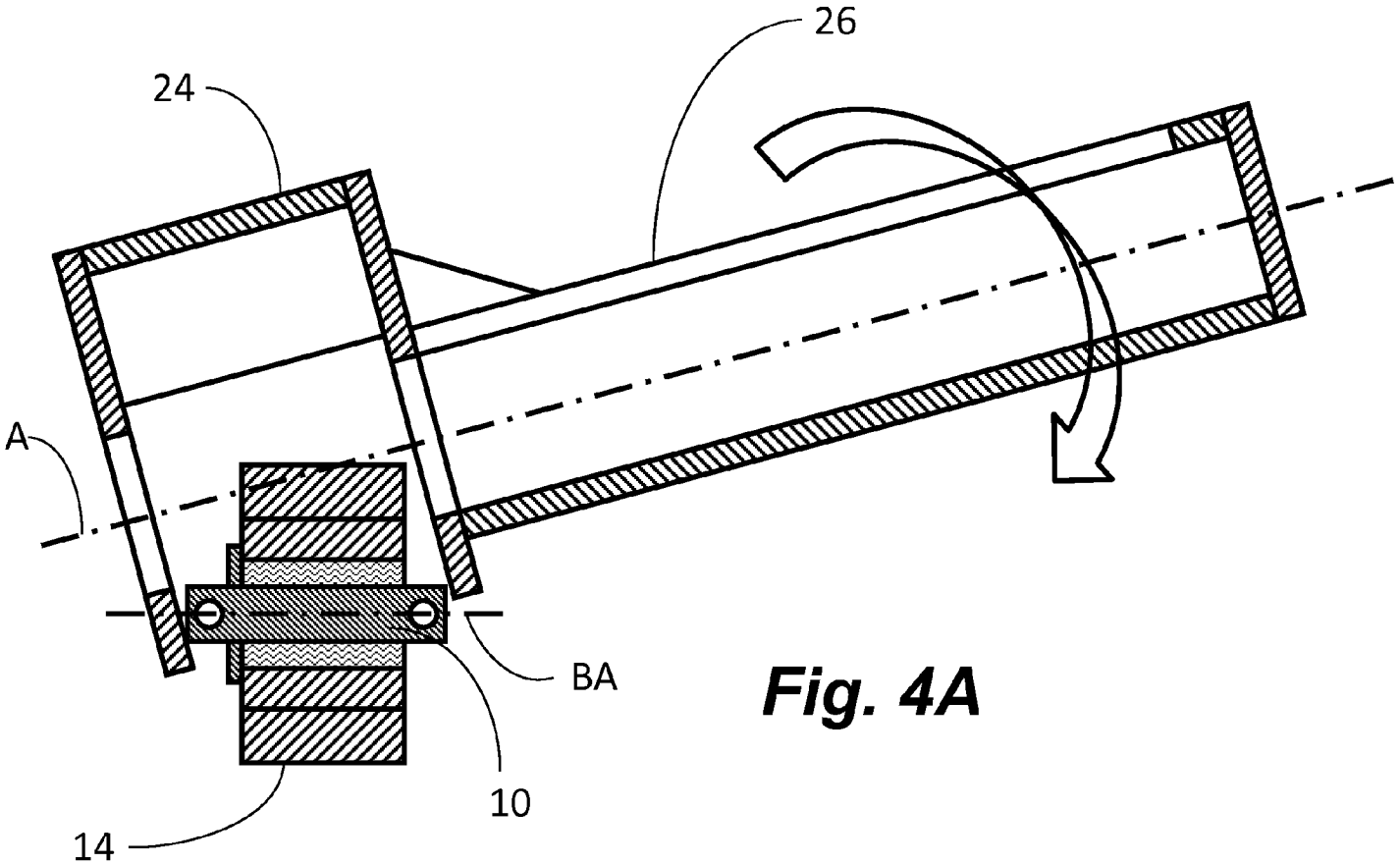
FIGS. 4A through 4J are successive views of the extraction of a bushing from a leaf spring, namely FIG. 4A orienting the tool about the suspension spring, FIG. 4B aligning the tool and bushing, FIG. 4C positioning the adapter, FIG. 4D inserting the portable hydraulic ram, FIG. 4E preparing to actuate the ram, FIG. 4F engaging the ram and adapter with the bushing, FIG. 4G taking up the tool anchor plate to spring slack, FIG. 4H breaking the bushing eyelet connection, FIG. 4I pushing the bushing from the eyelet, and FIG. 4J recovering the bushing.
Figure 4B:
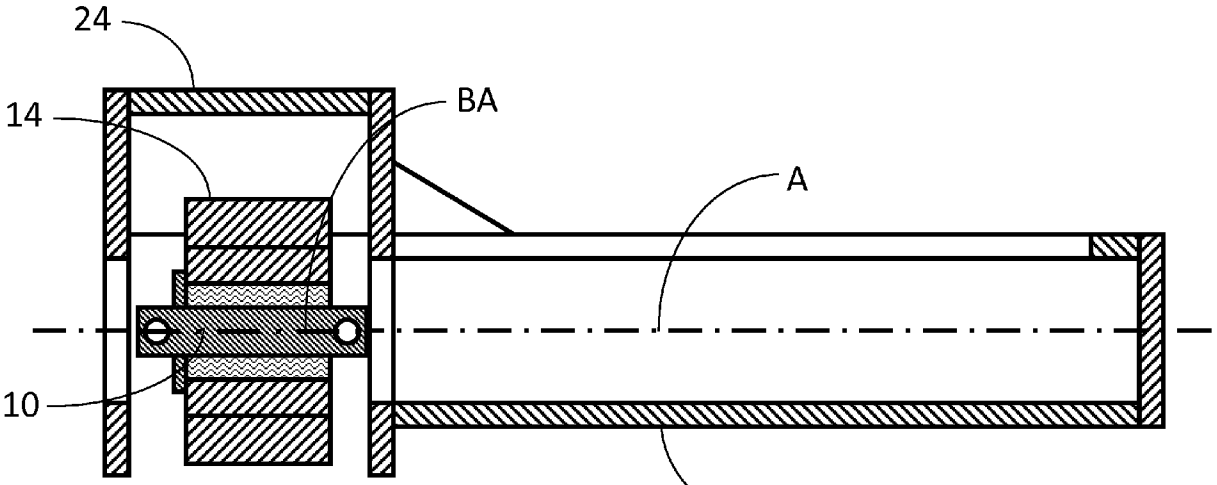

As shown in FIGS. 3A and 4B, the longitudinal tool axis A of the service tool 20 can be aligned with the bushing axis BA of a bushing 10 fit to the suspension S. The tool end 24 comprises the anchor plate 40 and interface plate 42 spaced axially sufficiently to be arranged about or straddle the suspension S. The plates 40,42 can be circular for minimizing material, avoiding sharp corners and maximizing visibility into the housing port 28 during use. The plates 40,42 are connected by the spacer 41, such a length of an arc of a large conduit or pipe, leaving about one-half or more of the circumference free for receiving the suspension S. As shown in FIG. 3B, the anchor plate 40 has a through extraction port 50, aligned with the passageway 48 for passing a bushing 10 therethrough.

As shown in FIG. 3C, gussets 54 can be located between the connective spacer 52 and interface plate 42 to resist reactive jacking forces from the base plate 44, through the connective spacer 52 and into the tool end. Note that the tool end 24 forms a housing port 28 deep enough to accommodate the suspension while aligning the busing axis BA with the tool axis A. The actuator end 26 need not be as deep as the tool end 24, therefore can comprise smaller structure, offset from the tool end 24 yet with it's axis A coincident with the tool axis A overall. The gussets 54,54 can aid if providing structural rigidity to the resulting offset.

In brief and as illustrated in FIGS. 4A through 4J, for extraction of the bushing 10 from the eyelet 12, the actuator 30 urges the bushing 10 along the axis A towards the anchor plate 40. While there is any space or slack between the suspension S and the anchor plate, the eyelet 12 and suspension S are urged to move with the bushing 10 towards the anchor plate 40. When the suspension S engages and is supported by the anchor plate 40, the actuator 30 can generate enough force to free and urge the bushing 10 axially from the eyelet 12. The bushing 10 is extracted from the eyelet 12 and moved at least partially through the extraction port 50. When the bushing 10 is free of the eyelet, it can be retrieved for refurbishing or disposal.

In brief and as illustrated in FIGS. 5A through 5G for installation, the bushing 10 is forcibly driven into the eyelet 12. Again, as the bushing 10 is forced into the suspension S, should there be any space or slack between the suspension S and the anchor plate 40, the suspension S moves with the bushing 10 towards the anchor plate 40. When the suspension S is supported by the anchor plate 40, the actuator 30 can urge the bushing 10 into the eyelet 12.

Extraction

As shown in the steps set forth in FIGS. 4A through 4J, the bushing 10 and suspension S have already been disconnected from the vehicle's frame hanger. A vehicle jack and jack stands are typically employed to suspend the vehicle frame during the bushing replacement. In an embodiment, the bushing 10 and a leaf spring 14 are hanging or otherwise supported under the vehicle.

In FIG. 4A, the tool end 24 of the service tool 20 is oriented or manipulated over the leaf spring 14 and old bushing 10. In FIG. 4B, the tool axis A is aligned with the bushing axis BA of the bushing 10.

Figure 4C:
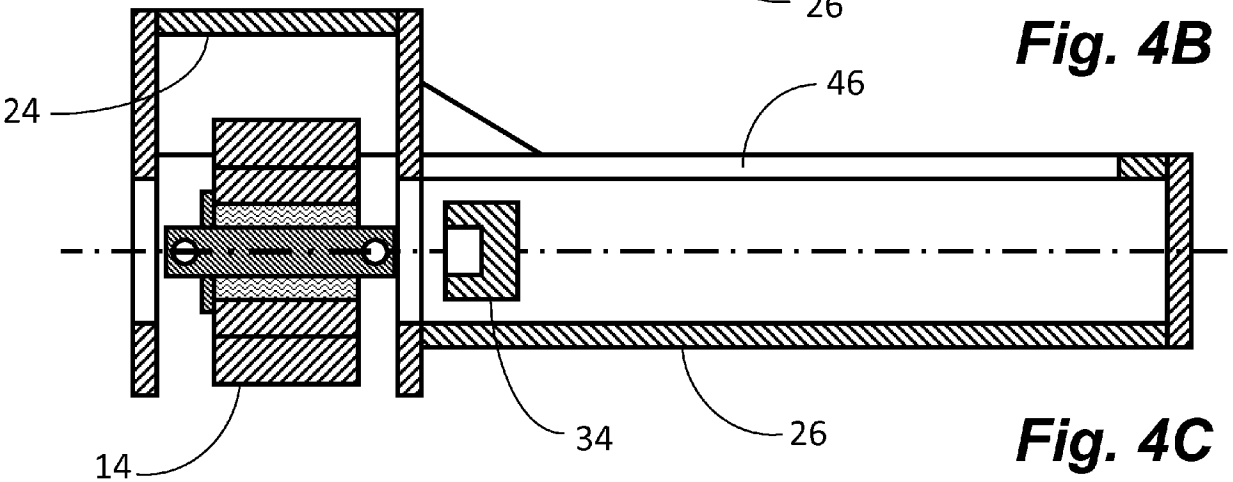

In FIG. 4C, the bushing cap or adapter 34 is inserted through the open side 46 of the actuator end 26 for positioning in the bore 27.

Figure 4D:
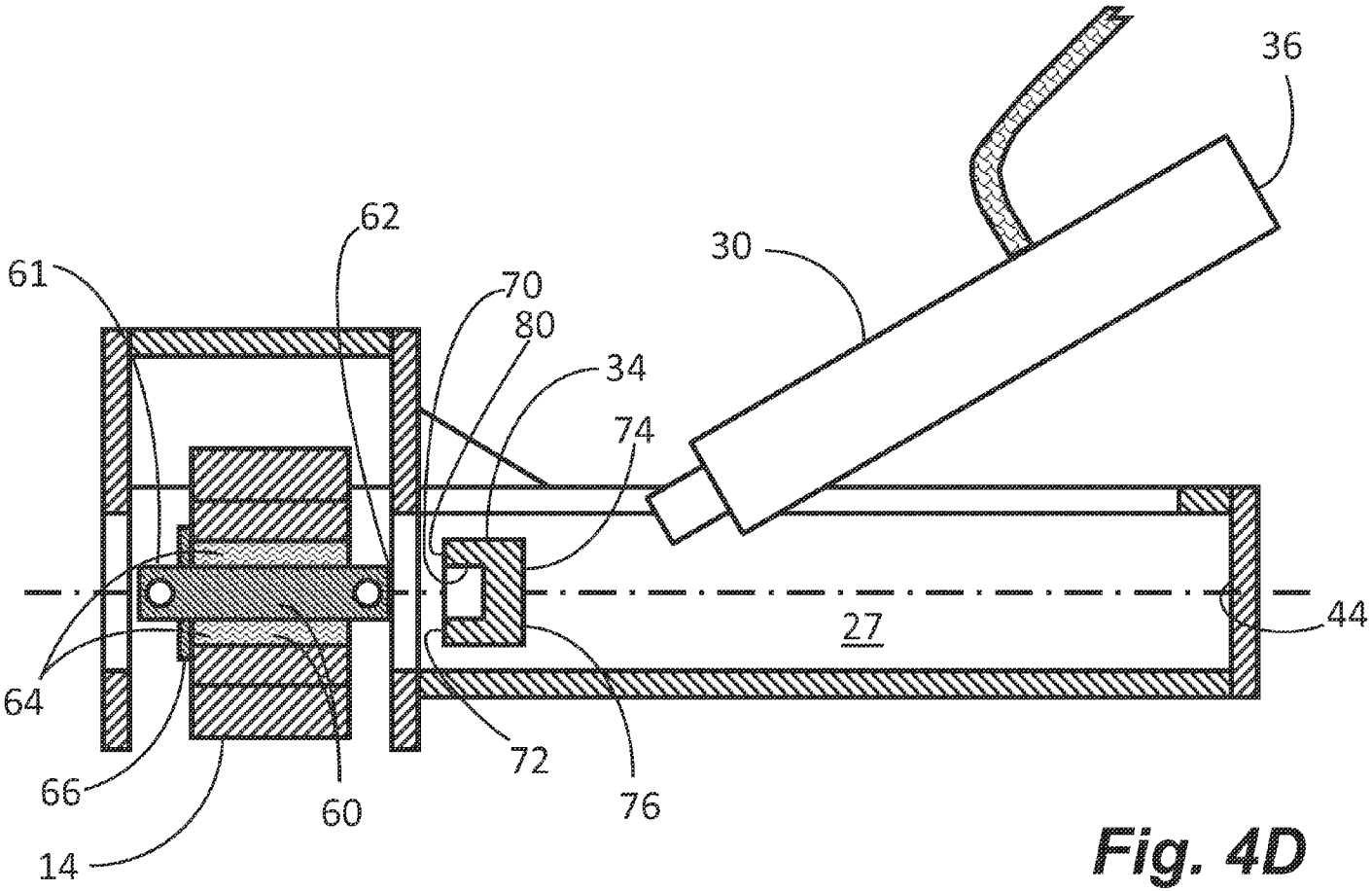

In FIG. 4D, the portable power unit or actuator 30 is fit through the open side 46 into the bore 27 of actuator end 26.

Also, as shown in FIG. 4D, the bushing 10 typically has a pin 60 portion having first and second pin ends 61, 62 for removable connection to the vehicle suspension hangers (not shown). An annular elastomeric portion 64, hereinafter referred to rubber, regardless of the elastomer used, surrounds the pin 60 and is sized to the eyelet 12. The adapter 34 can be positioned between the working end 32 of the actuator and the bushing 10 for directing the jacking force at least partially into the annular elastomeric portion 64.

One end of the bushing, such as the first end 61, may have a washer portion 66 extending radially beyond the pin and over the rubber portion 64. The adapter 34 is generally cylindrical and has a recess 70 at a first bushing end 72 and a pushing surface 74 at the opposing working end 76. The bushing end 72 has an annular shoulder 80 about the recess 70. The adapter recess 70 is aligned to receive the pin's second end 62 and the annular shoulder 80 engages the rubber portion 64. During extraction, the adapter's annular shoulder 80 pushes on the rubber to avoid merely extracting the pin 60 from the rubber and instead ensures both pin 60 and rubber 64 are extracted from the eyelet 12.

Figure 4E:
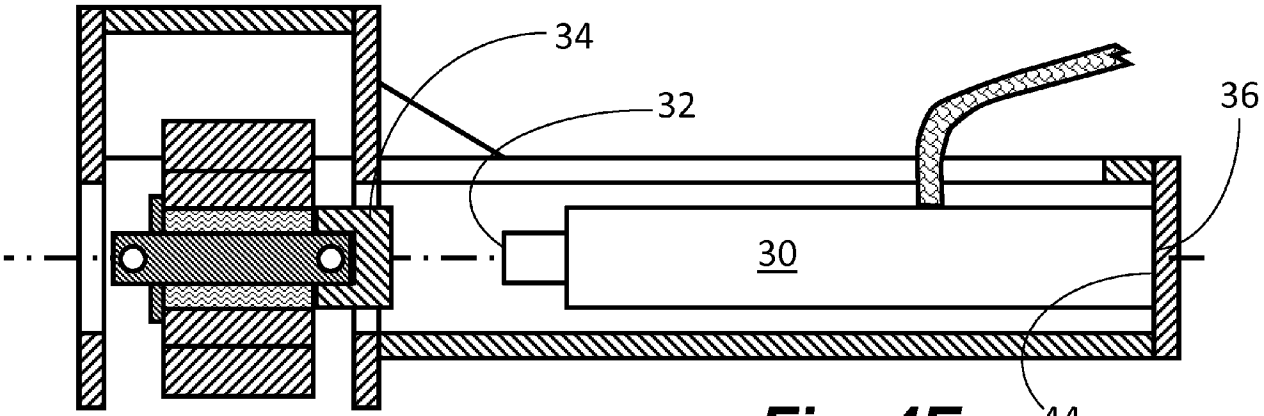
Figure 4F:
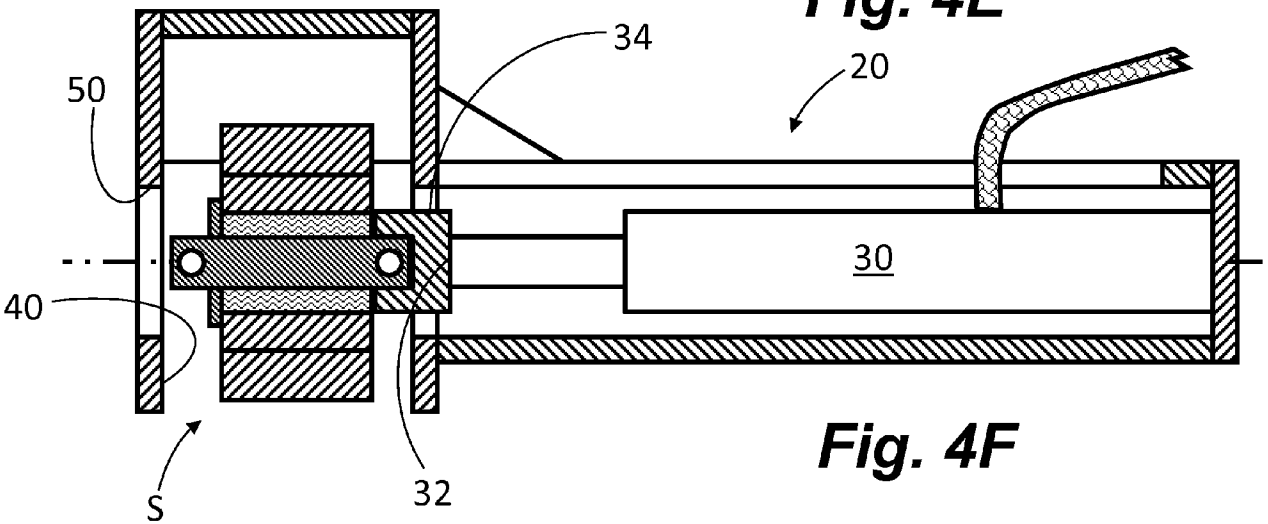

In FIG. 4E, the support end 36 of the actuator 30 is resting against the base plate 44 of the actuator end. When actuated, as shown in FIG. 4F, the working end 32, or ram, extends from the actuator 30 to engage the adapter 34 and commence pushing the bushing 10 from the suspension S.

Figure 4G:
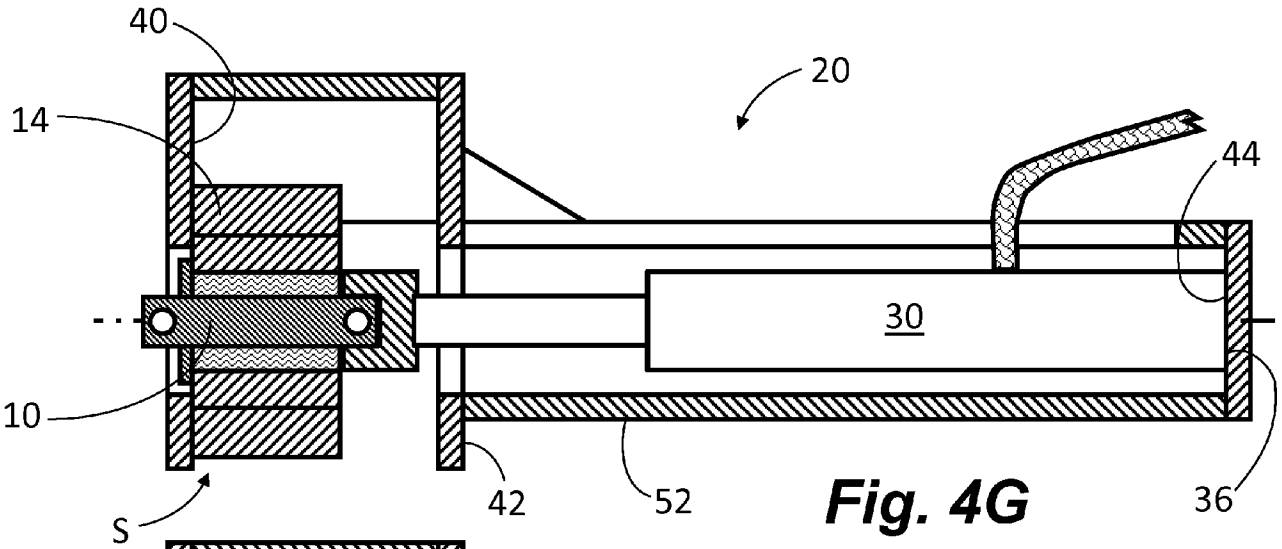

In FIG. 4G, the actuator 30 pushes the adapter 34 against the bushing 10. As the bushing 10 tends to resist extraction, the service tool 20 moves reactively back to take up the slack between the anchor plate 40 and the suspension S. Once the anchor plate 40 presses against the suspension S, such as the eyelet 12 of the leaf spring 14, then the full force of the actuator 30 can be applied to extract the bushing 10 from the eyelet 12, the reactive load path being between the working end 32 of the actuator 30, the actuator's support base 36, the base plate 44, the connective spacer 52, and to the anchor plate 40 of the tool end 24.

Figure 4H:
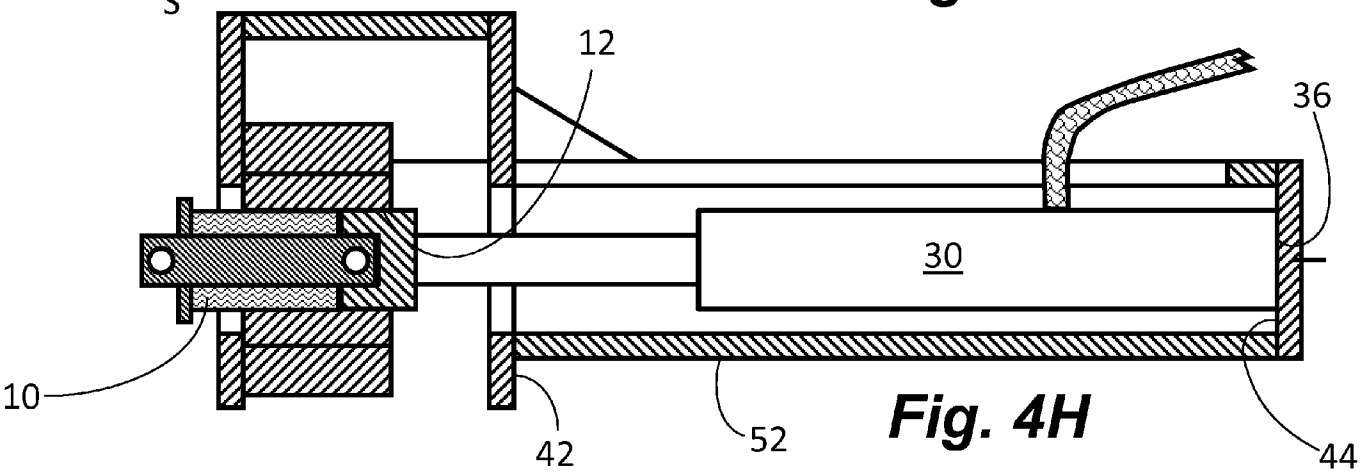
Figure 4I:
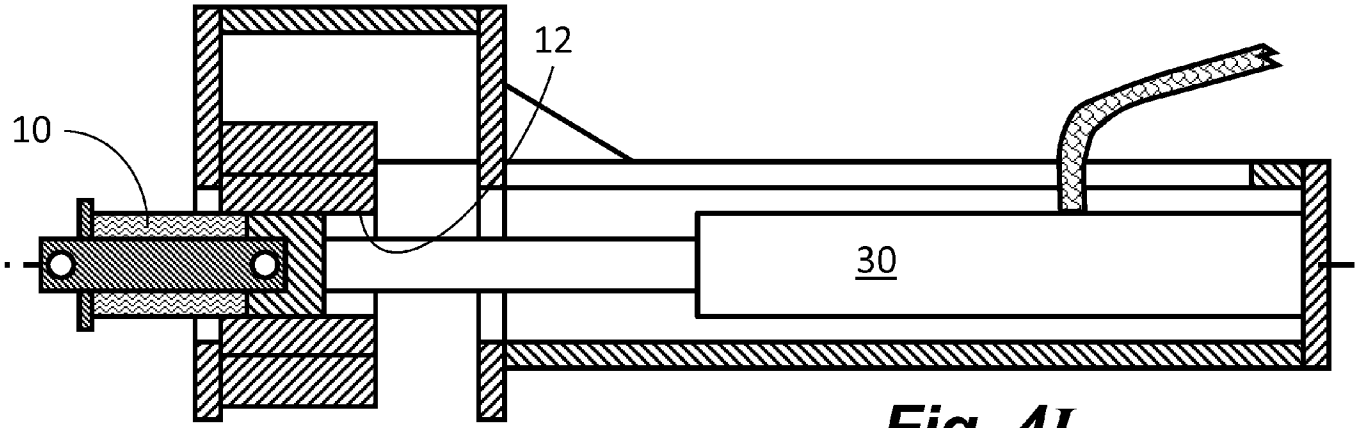
Figure 4J:
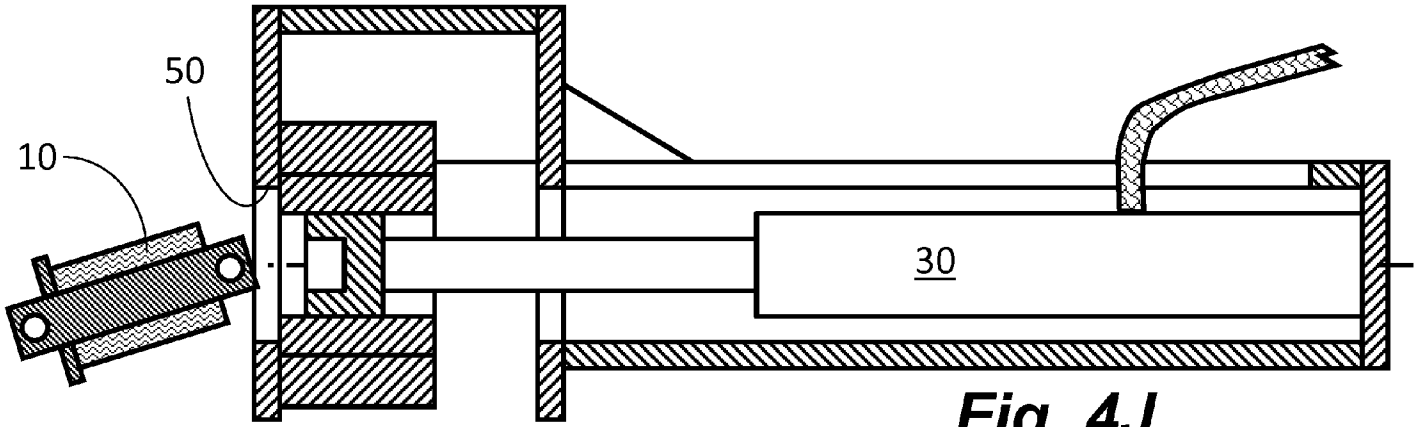

In FIG. 4H, the bushing 10 finally begins to move axially from the eyelet 12. Sometimes, one may have to hammer on the actuator end 26 at the base plate 44 to apply a sharp loading into the bushing 10 to jar the bushing/eyelet interface loose. In FIG. 4I, the old bushing 10 passes through the extraction port 50, and in FIG. 4J the old bushing is shown freed from the eyelet 12. The adapter 43 falls out of the tool, or is otherwise retrieved from the eyelet 12, the actuator 30 removed and the frame of the service tool 20 removed from about the suspension S.

Installation

Typically a new bushing 10 is installed from the same side of the suspension S that the old bushing was extracted, particularly where the bushing incorporates the washer 66 at the pin's first end 61. Accordingly, and having reference to FIGS. 5A through 5G, the service tool 20 frame is reversed as necessary to push a new bushing 10 into the eyelet 12 from which the old bushing was extracted. Successive views are shown of the insertion of a new bushing 10 into the eyelet 12 of the leaf spring 14.

Figure 5A:
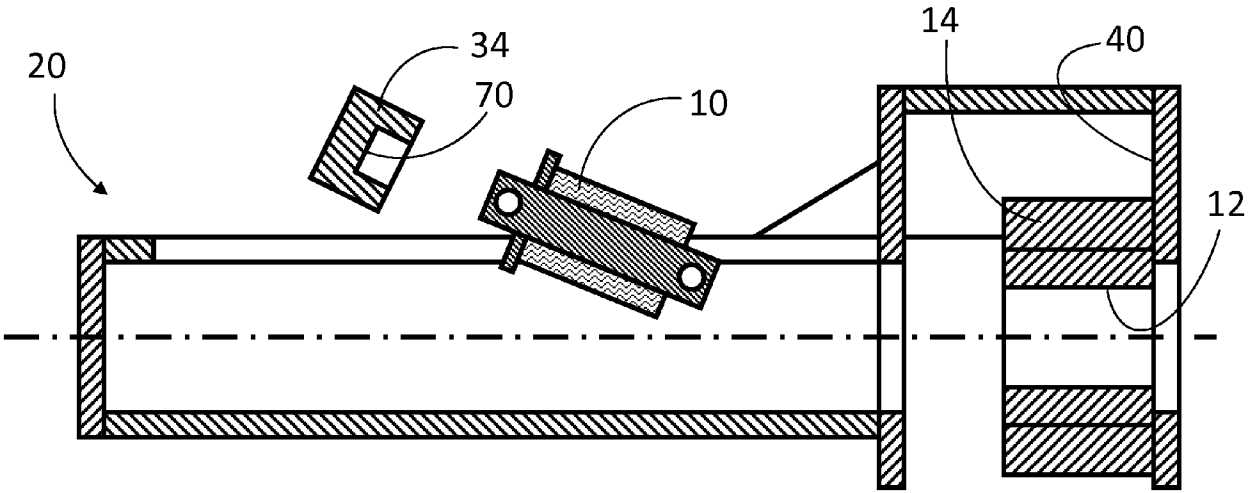
FIGS. 5A through 5G are successive views of the installation of a new bushing into a leaf spring eyelet, namely.
Figure 5B:
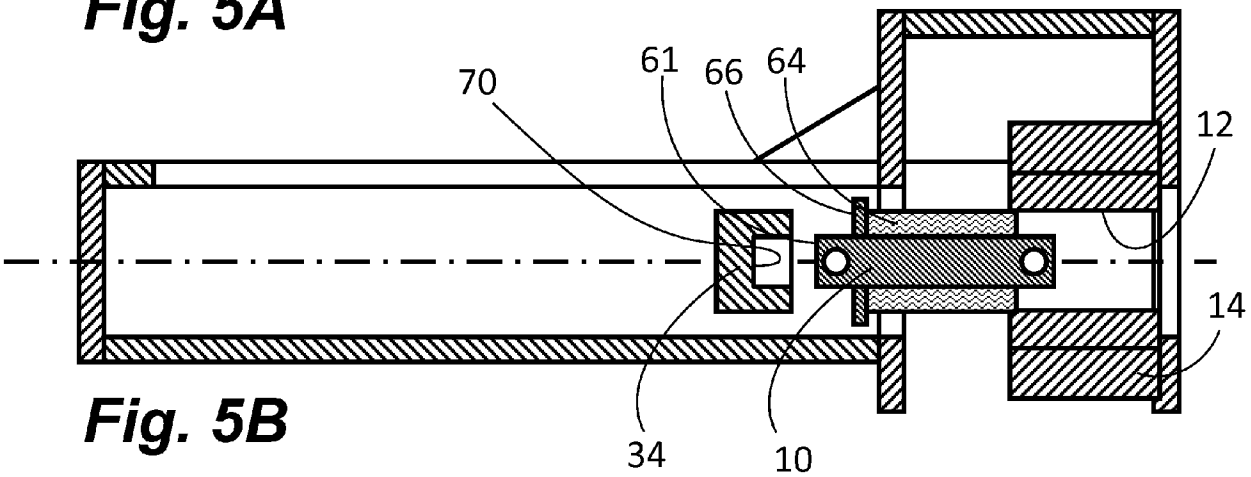

In FIG. 5A, the tool end 24 of the service tool 20 is manipulated over the suspension eyelet 12. A new bushing 10 is provided and inserted into the actuator end's open side 46. In FIG. 5B, the adapter 34 is oriented for placing the recess 70 over the pin end 61 and engaging the annular shoulder 80 with the rubber 64 or washer portion 66.

Figure 5C:
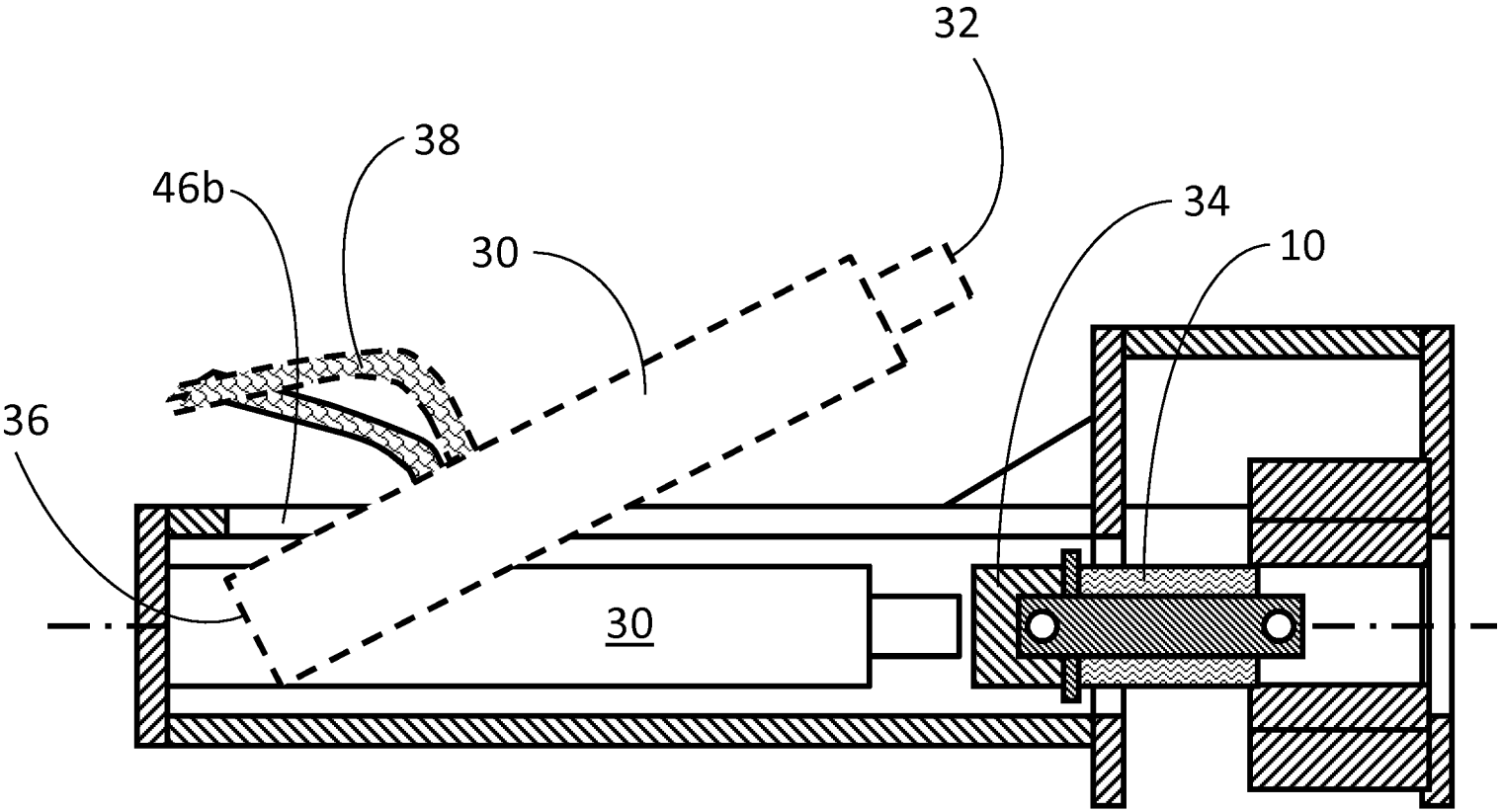

In FIG. 5C, the actuator 30 (initially shown external to the actuator end 26 in dotted lines) is inserted through the open side 46 into bore 27, the actuator 30 being lowered with its support end 36 into the second slot 46*b* (shown in solid lines) for placing the actuator's support end adjacent the base plate 44. The hydraulic line 38 extends laterally through the second slot 46*b*. The balance of the actuator 30 is fit entirely within the bore 27 of actuator end 26 through the first slot 46*a*. The working end 32 of the actuator engages the bushing 10, or adapter 34 if so fit, and actuated to more axially and take up the slack between the suspension S and the anchor plate 40.

Figure 5D:
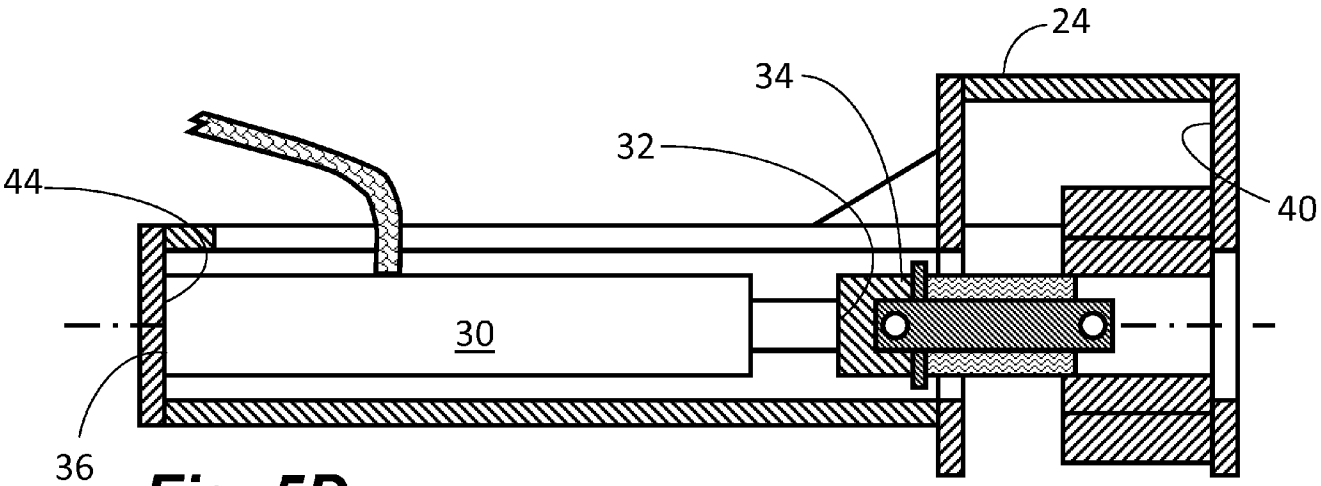

In FIG. 5D, the bushing 10 is aligned with the eyelet 12 and the actuator 30 is ready to push.

Figure 5E:
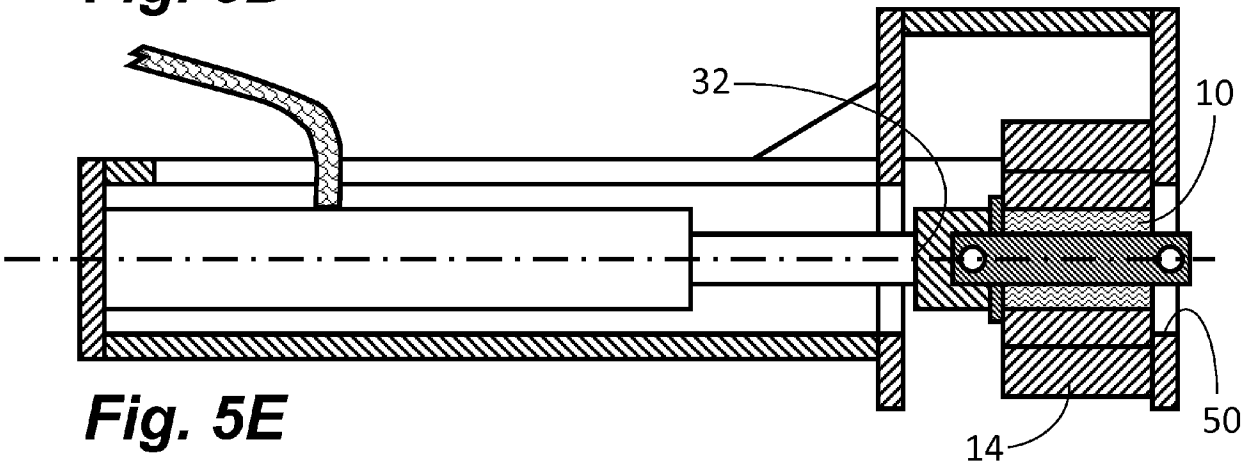
Figure 5F:
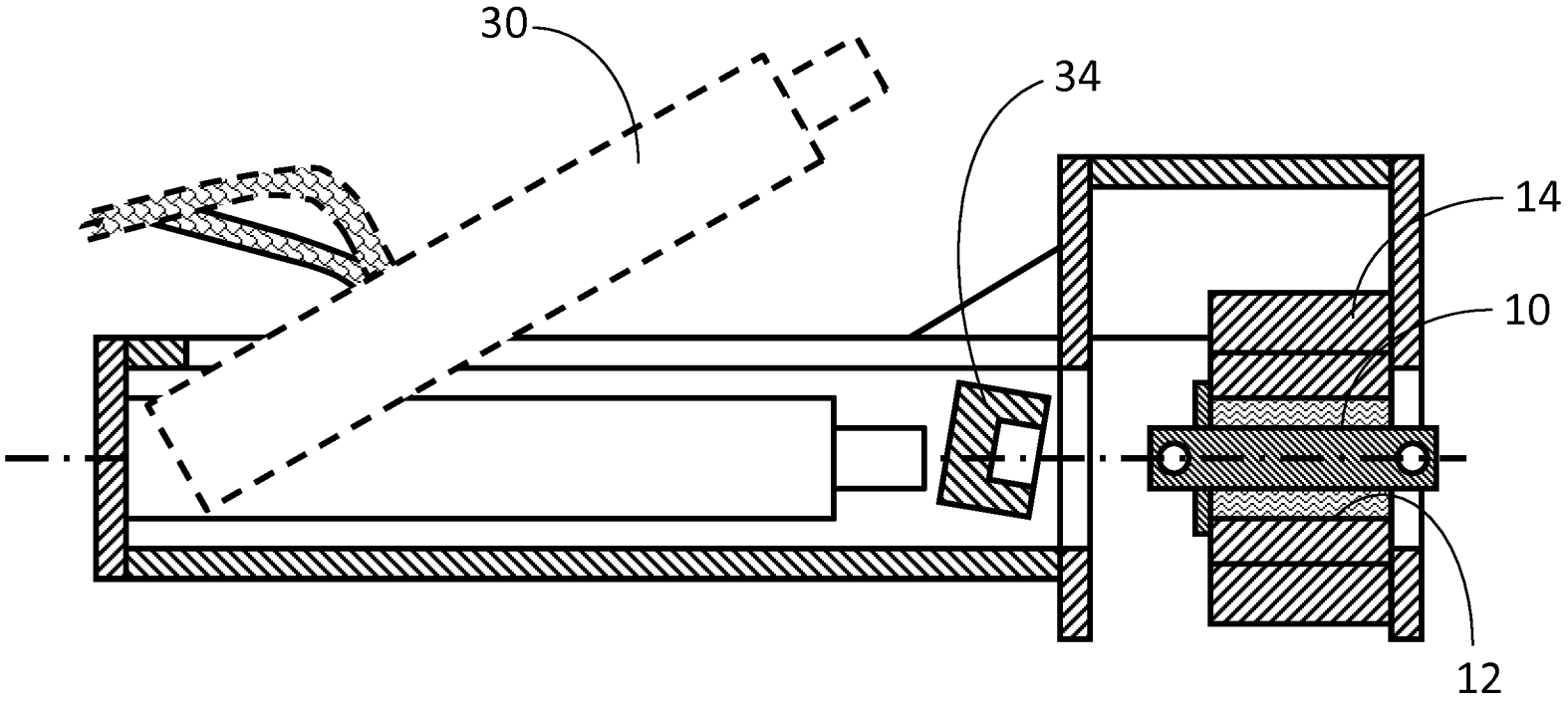
Figure 5G:
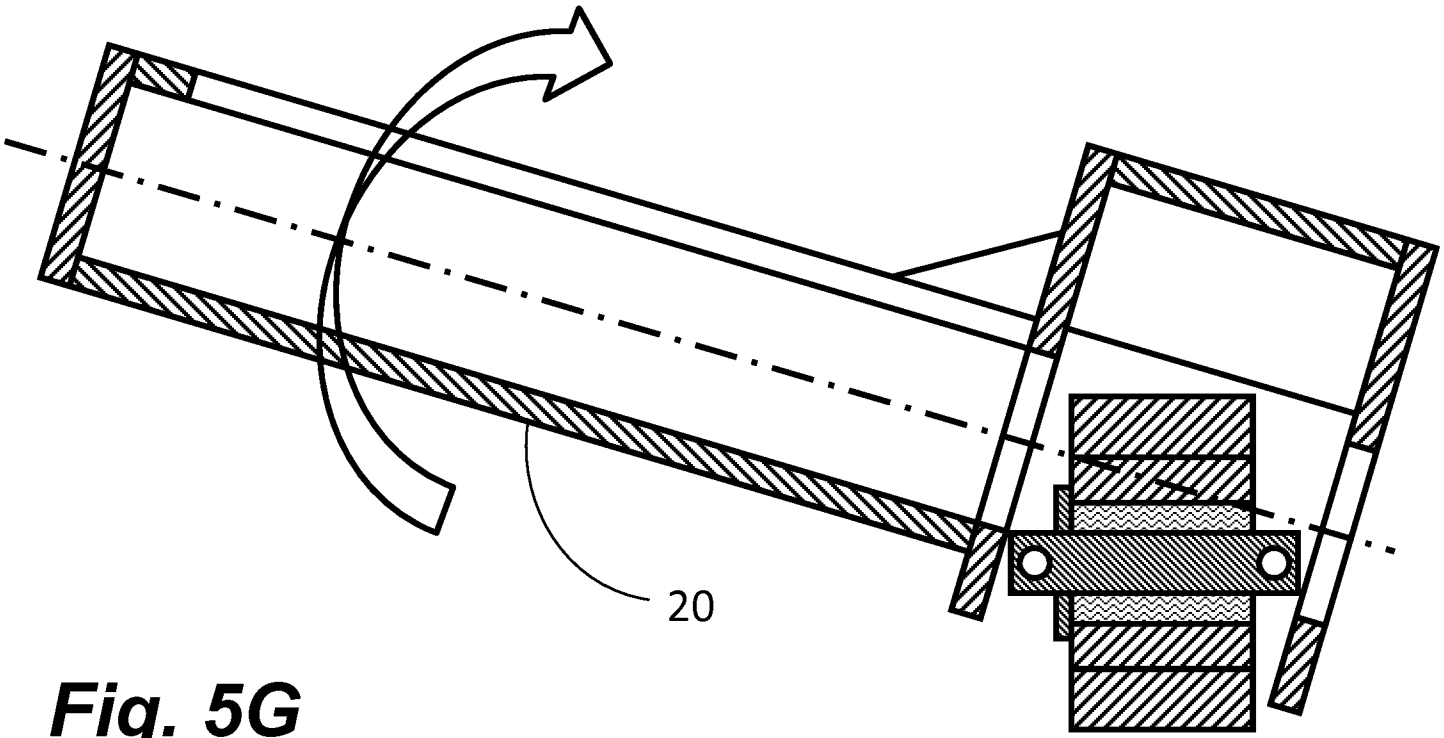

In FIG. 5E, the actuator 30 has been actuated, in one continuous movement or in increments, and has fully positioned the bushing 10 into the eyelet 12. In FIG. 5F, the user recovers the actuator 30 and adapter 34 from the actuator end 26. In FIG. 5G, the service tool 20 is removed from the suspension S.

The pins 60 of the new bushing 10 can be reconnected and reinstalled to the vehicle's frame hangers and the service personnel can move to the next bushing.

Example dimensions for a service tool 20 suitable for servicing Hendrickson suspensions include a frame having an actuator end connecting spacer 52 formed of 16 inch length of four inch Sch. 40 pipe. The diameter and structural spacer portion 41 of the tool end 24 is formed by a six inch length of eight inch Sch. 80 pipe, the circumference of the pipe being discontinuous and forming an arc, being about 270 degree or sufficient to form about a seven inch opening to admit a leaf spring eyelet 12. In this embodiment, the pipe axes are parallel, yet offset by about ¾ inches. The tool end 24 pipe arc spaces the straddle plates of the anchor and interface plates 40, 42. The anchor plate can be an eight inch diameter, ¾ inch plate and the interface plate can be an eight inch diameter, ½ inch plate situate between the tool end 24 and the actuator end

26. The actuator end 26 is fit with a ¾ inch base plate 44, the base plate being spaced from the interface plate by the connecting spacer 52 formed of the four inch pipe. The interface plate 42 is fit with a 3⅜ inch diameter passage 48, aligned with the tool axis A, suitable to pass a bushing 10 therethrough. The anchor plate 40 is fit with the extraction port 50, again sized to pass a bushing 10, the extraction port 50 being aligned with the tool axis A. The open side 26 of the actuator end pipe is sized to accept a hydraulic ram, for example, the first slot 46*a* extending longitudinally away from the interface plate 42 having a slot width Wa of about 3¼ inches and a length of 6½ inches. The remaining open side or second slot 46*b* extends longitudinally towards the base plate 44 and can be sized smaller than the cylinder diameter of the hydraulic ram actuator 30, but sufficient to pass the hydraulic hose 38 without interference. A slot width Wb of 2½ inches is suitable. The four inch pipe 52 to interface plate 42 connection is strengthened with a pair of ¼ thick gusset plates 54,54 straddling the open side 46 of the jack housing. The entire tool 20 can be formed of steel for ease of manufacture using welding techniques although other suitably strong materials of construction and machined components and assembly are contemplated.

The embodiments of the invention for which an exclusive property or privilege is claimed are defined as follows:

1. A service tool for extracting and installing a bushing in an eyelet of a vehicular suspension using an actuator, the service tool comprising:

a frame having an actuator end for supporting the actuator, and a tool end, the actuator end and tool end aligned along a longitudinal tool axis;

the tool end further comprising first and second straddle plates spaced and connected together for forming a housing port open laterally to a side of the frame and aligned along the tool axis between the first straddle plate and the actuator end, the first straddle plate forming an anchor plate and the second straddle plate forming an interface plate between the tool end and the actuator end, the first and second straddle plates being connected together by a wall extending between the plates and being discontinous for forming the housing port, and the interface platge having a passage therethrough sized to freely pass the bushing, the first straddle having an extraction port therethrough along the tool axis;

the housing port sized to accept the suspension from the side of the frame with the suspension adjacent the anchor plate and a bushing aligned along the tool axis, the actuator being operable between the actuator end and the bushing;

wherein when the actuator is actuated to engage the bushing, the actuator urges the suspension to bear against the anchor plate for support thereby; and for installation, the bushing is urged into the supported suspension, and for extraction, the bushing is urged out of the supported suspension and at least partially through the extraction port.

2. The service tool of claim 1 wherein the actuator is incorporated into the actuator end.

3. The service tool of claim 1 wherein the actuator is removably separable from the actuator end.

4. The service tool of claim 3 wherein the actuator end comprises a base plate connected to and spaced from the tool end, the actuator end having an open side for the receiving the actuator therein.

5. The service tool of claim 4 wherein when the actuator is a hydraulic ram having a ram base end, the ram base end is supportable against the base plate.

6. The service tool of claim 5 wherein when the actuator has an actuator diameter and a laterally extending hydraulic line adjacent the open side of the actuator end, the open side of the actuator end further comprises:

a first slot width adjacent the tool end for receiving the actuator diameter therein and having a longitudinal length for receiving the actuator into the actuator end; and a second slot width extending longitudinally from the first slot width to a location the adjacent the base plate and being smaller than the actuator diameter, the second slot width accommodating the hydraulic line.

7. A service tool for extracting and installing a bushing in an eyelet of a vehicular suspension using an actuator, the service tool comprising:

a frame having a base end and a tool end, the tool end having a first straddle plate and a second straddle plate, the first and second straddle plates spaced and connected together to form a housing port open laterally to a side of the frame and aligned along a longitudinal-tool axis between the base end and the tool end, the first and second straddle plates being connected by a wall extending therebetween, the wall being discontinous for forming the housing port, the first straddle plate having an extraction port therethrough along the tool axis and the second straddle plate having a passage therethrough sized to freely pass the busying:

the housing port sized to accept the suspension from the side of the frame with the suspension adjacent the anchor end and a bushing axis aligned along the tool axis, the actuator being operable between the base and the bushing;

the anchor end having an extraction port along the tool axis, wherein when the actuator is extended to engage the bushing, the suspension is urged against the anchor end and supported thereby; and for installation, the bushing is urged into the suspension, and for extraction, the bushing is urged out of the suspension and at least partially through the extraction port.

8. The service tool of claim 7 further comprising:

an cylindrical adapter for positioning between the actuator and the bushing, the adapter having a pushing end configured to receive actuating load, and an annular bushing end configured to engage a periphery of the bushing.

9. The service tool of claim 8 wherein:

the frame further comprises an interface plate between the base end and the anchor end, the housing port straddled by the anchor end and the interface plate;

the interface plate having a passage therethrough sized to freely pass the bushing.

10. The service tool of claim 9 wherein the interface plate and anchor end are connected and spaced apart by a spacer at least a portion of which has an open side forming the housing port, further comprising:

an adapter having an actuating end and a bushing end, wherein:

the actuating end is configured to receive actuating load, and the bushing end is configured to engage a periphery of the bushing.

11. A service tool for extracting and installing a bushing in an eyelet of a vehicular suspension using a hydraulic ram separable from the tool, the service tool comprising:

a frame having an actuator end and a tool end, the actuator end and tool end aligned along a longitudinal tool axis;

the actuator end further comprising a base plate connected to and spaced from the tool end, and having an open side for removably receiving the hydraulic ram therein;

the tool end forming a housing port open laterally to a side of the frame and aligned along the tool axis between an anchor plate and the actuator end, the anchor plate having an extraction port therethrough along the tool axis;

the housing port sized to accept the suspension from the side of the frame with the housing adjacent the anchor plate and a bushing aligned along the tool axis, the hydraulic ram being operable between the actuator end and the bushing;

wherein when the hydraulic ram is actuated to engage the bushing, the hydraulic ram is supported against the base plate of the actuator end, and urges the bushing to bear against the anchor plate for support thereby; and for installation, the bushing is urged into the supported suspension, and for extraction, the bushing is urged out of the supported suspension and at least partially through the through port; and wherein when the hydraulic ram has a diameter and a laterally extending hydraulic line adjacent the open side of the actuator end, the open side of the actuator end further comprises a first slot width adjacent the tool end for receiving the diameter therein and having a longitudinal length for receiving the hydraulic ram into the actuator end; and a second slot width extending longitudinally from the first slot width to a location adjacent the base plate and being smaller than the diameter, the second slot width accommodating the hydraulic line.

12. The service tool of claim 11, wherein the tool end comprises first and second straddle plates spaced and connected together to form the housing port, the first straddle plate forming the anchor plate and the second straddle plate forming an interface plate between the tool end and the actuator end, the base plate being connected to the interface plate; and the interface plate having a passage therethrough sized to freely pass the bushing.

* * * * *